US005197342A

United States Patent [19]

Nakagawa

[11] Patent Number: 5,197,342

[45] Date of Patent: Mar. 30, 1993

[54] PINION STOPPER FOR STARTER

[75] Inventor: Taiichi Nakagawa, Hyogo, Japan

[73] Assignee: Mitsubishi Denki Kabushiki Kaisha, Japan

[21] Appl. No.: 692,952

[22] Filed: Apr. 25, 1991

Related U.S. Application Data

[63] Continuation of Ser. No. 453,050, Dec. 13, 1989, abandoned, which is a continuation of Ser. No. 166,635, Mar. 11, 1988, abandoned.

[30] Foreign Application Priority Data

Mar. 12, 1987 [JP] Japan ..... 62-37723[U]
Oct. 28, 1987 [JP] Japan ..... 62-165631[U]

[51] Int. Cl.[5] ..... F02N 15/06
[52] U.S. Cl. ..... 74/7 A; 74/7 C
[58] Field of Search ..... 74/6, 7 R, 7 A, 7 B, 74/7 C; 123/179 M; 290/48

[56] References Cited

U.S. PATENT DOCUMENTS

| | | | |
|---|---|---|---|
| 1,520,469 | 12/1924 | Dilson | 74/7 R |
| 1,923,908 | 8/1933 | Brockway | 74/7 R |
| 1,960,213 | 5/1934 | Brockway | 74/7 R |
| 3,124,694 | 3/1964 | Seilly | 74/7 R |
| 3,171,284 | 3/1965 | Scherzinger | 123/179 M |
| 4,255,982 | 3/1981 | Kern | 74/7 R |
| 4,304,140 | 12/1981 | Ebihara | 74/7 R |
| 4,507,987 | 4/1985 | Tanaka et al. | 74/7 E |
| 4,613,761 | 9/1986 | Yabanaka | 290/36 R |
| 4,825,095 | 4/1989 | Morishita et al. | 290/48 |
| 4,916,958 | 4/1990 | Okamoto et al. | 74/6 |
| 5,018,398 | 5/1991 | Nakagawa | 74/7 R |

FOREIGN PATENT DOCUMENTS

| | | | |
|---|---|---|---|
| 115852 | 8/1984 | European Pat. Off. . | |
| 1191994 | 4/1965 | Fed. Rep. of Germany . | |
| 54-132032 | 10/1979 | Japan | 290/48 |
| 54-138926 | 10/1979 | Japan | 74/7 R |
| 533839 | 2/1941 | United Kingdom | 74/7 R |
| 2142094 | 1/1985 | United Kingdom . | |

OTHER PUBLICATIONS

Japanese Patent Public Disclosure (Kokai) No. 98962/1986; 17 May 1986.

Japanese Utility Model Publication (Kokoku) No. 3677/1986; 24 Oct. 1986.

*Primary Examiner*—Allan D. Herrmann

*Attorney, Agent, or Firm*—Wolf, Greenfield & Sacks

[57] ABSTRACT

A section of the normal internal bore of a starter pinion gear drive mechanism which allows the drive mechanism to slide over the starter drive shaft is enlarged in diameter. When the pinion gear is shifted to engage the flywheel of an engine, the enlarged bore section slides over a snap ring stop on the drive shaft. The snap ring limits travel of the pinion gear drive mechanism over the drive shaft by engaging the inner end of the enlarged bore. The arrangement allows the use of a short starter drive shaft which reduces interference between the drive shaft and a flywheel or the like. In addition, when the pinion drive mechanism is at rest, the snap ring stop effectively seals the outer end of the enlarged bore thus helping to prevent dirt from reaching the starter drive shaft.

29 Claims, 4 Drawing Sheets

PINION STOPPER FOR STARTER

This application is a continuation of application Ser. No. 07/453,050, filed Dec. 13, 1989 now abandoned, which is a continuation of application Ser. No. 07/166,635, filed Mar. 11, 1988 now abandoned.

BACKGROUND OF THE INVENTION:

1. Field of the Invention

The present invention relates to a pinion stopper for a starter. More particularly, the present invention pertains to a pinion stopper for use in an overhang type starter in which a pinion is disposed forward of a bearing.

2. Description of the Prior Art

FIG. 1 is a sectional view of a conventional pinion stopper used in a front nose type starter. In this figure, reference numeral 1 denotes an armature of a DC motor, and 2 an armature rotary shaft. An epicyclic reduction gear 3 is provided at the forward end of the armature rotary shaft 2. A yoke 4 has permanent magnets 5 producing magnetic fields which are rigidly secured to its inner peripheral surface. Reference numeral 6 denotes an output rotary shaft to which rotational force is transmitted from the epicyclic reduction gear 3. A helical spline 7 is formed on the outer periphery of the output rotary shaft 6, and an overrunning clutch 8 is axially slidably fitted on the output rotary shaft 6 through the helical spline 7. A pinion 9 is connected to the overrunning clutch 8 in one unit, so that the pinion 9 is movable back and forth in the axial direction of the output rotary shaft 8. The numeral 10 denotes a stopper means which is provided on the output rotary shaft 6 to limit the axial movement of the pinion 9. The stopper means 10 comprises a ring 11*a* fitted in a recess formed in the output rotary shaft 6 and a stopper member 11*b* which is engaged with the ring 11*a*. The numeral 12 denotes a sleeve bearing which is provided at the forward end portion of a front bracket 13 to support the forward end portion of the output rotary shaft 6. The numeral 14 denotes a lever formed of a resin material. The lever 14 is pivotally mounted with one end thereof connected to a plunger (not shown) of an electromagnetic solenoid 15 and the other end thereof connected to the rear end of the overrunning clutch 8.

FIG. 2 shows an overhang type starter wherein the pinion is disposed forward of a bearing which is fitted to the front bracket. In this figure, the lower-half of a pinion driving shaft 16 shows the shaft 16 moved forward to mesh with a ring gear 30. The pinion driving shaft 20 which has a gear 20 generated in its distal end portion is supported by a bearing 18 fitted to a front bracket 17. A stopper means 24 is provided forward of the distal end of the pinion driving shaft 16 to limit the axial movement of the shaft 16. The stopper means 24 comprises a ring 26 fitted in a recess 25 formed in the distal end portion of the output shaft 6 and a stopper member 27 which is loosely fitted on the ring 26.

In the above-described starters, when a starting switch is turned on, the electromagnetic switch 15 is actuated. As a result, the DC motor is energized and the armature 1 generates rotational force. At the same time, the plunger of the electromagnetic solenoid 15 is drawn, and the lever 14 is thereby pivoted, thus causing the overrunning clutch 8 and the pinion 9 or 20 to move forward. At this time, the forward end of the pinion 9 or 20 abuts against the stopper means 10 or 27 and the extremity of its axial travel is thus defined. In this position, the pinion 9 or 20 meshes with the ring gear 30 of the engine to start it.

The above-described conventional pinion stoppers of the front nose type and overhang type starters suffer, however, from the following problems.

In either the front nose or overhang type starter, if the diameter of a flywheel of the engine which is located at the rear (as viewed from the starter) of the ring gear 30 is larger than the diameter of the ring gear 30, the output shaft 6 which projects forward from the distal end of the pinion 20, or the front bracket 13 which is located forward of the pinion 9, may interfere with the above-described flywheel. In such a case, it is impossible to select a desired flywheel configuration. Further, in the prior arts, the output shaft 6 with which is slidably engaged the pinion 9 or the pinion driving shaft 16 is partially exposed and there is therefore a fear of the pinion 9 or the pinion driving shaft 16 failing to slide smoothly because of corrosion of the exposed portion or adhesion of dust to it. In one type of conventional starter, the above-described stopper means is provided on that portion of the output rotary shaft 6 where the overrunning clutch 8 is slidably fitted. This prior art has, however, the problems that assembly is troublesome and the structure is complicated.

SUMMARY OF THE INVENTION

In view of the above-described problems of the prior arts, it is a primary object of the present invention to provide a pinion stopper for a starter which has no element projecting beyond the distal end of the pinion when meshed with the ring gear and which is superior in terms of dust-proofness and is easy to assemble.

To this end, the present invention provides a pinion stopper for a starter comprising: an output rotary shaft driven by an electric motor; a pinion driving shaft fitted on the output rotary shaft, the pinion driving shaft being slidable axially of the output rotary shaft; a pinion formed at the distal end portion of the pinion driving shaft; an enlarged-diameter portion formed on the inner periphery of the pinion driving shaft so as to extend over a predetermined length from the distal end thereof to define an annular space between the inner periphery of the pinion driving shaft and the peripheral surface of the output rotary shaft; a step portion formed at the terminating end of the enlarged-diameter portion in the pinion driving shaft; and stopper means provided on the distal end portion of the output rotary shaft so that, when the pinion driving shaft moves forward, the stopper means engages with the step portion to limit the distance of forward movement of the pinion driving shaft, whereas, when the pinion driving shaft is in an inoperative state, the stopper means is entirely or partially accommodated in the annular space.

To assemble the pinion means on the output rotary shaft, a stopper member is first fitted in the annular space and then a ring is fitted in a recess formed in the peripheral surface of the output rotary shaft and, in this state, the pinion driving shaft is moved forward. Accordingly, the stopper member abuts against the step portion of the pinion driving shaft and is thereby moved forward to engage with the ring so as to be secured.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and in which.

DESCRIPTION OF THE PREFERRED EMBODIMENTS

The present invention will be described hereinunder in detail with reference to the accompanying drawings.

Figure 1:
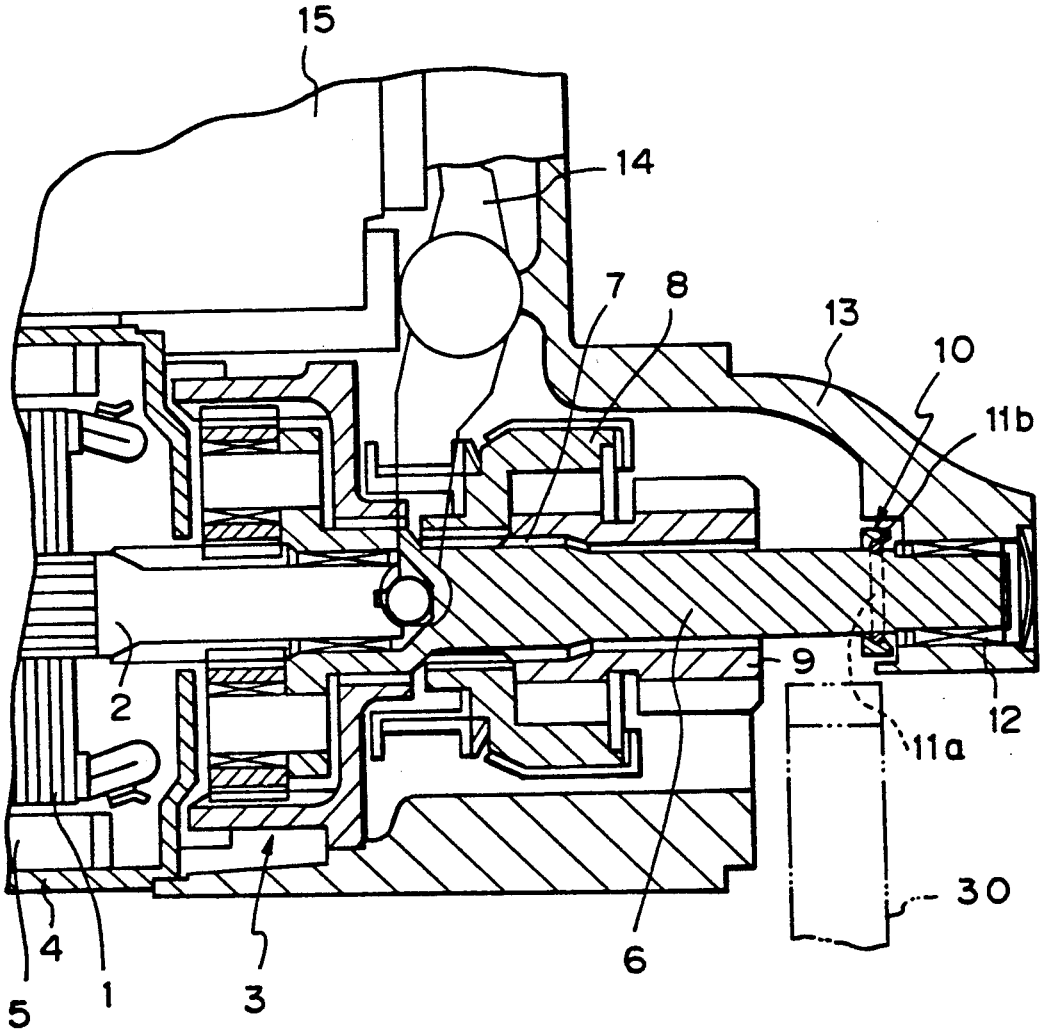
Fig. 1 PRIOR ART
FIG. 1 is a sectional view showing a conventional pinion stopper employed in a front nose type starter.
Figure 2:
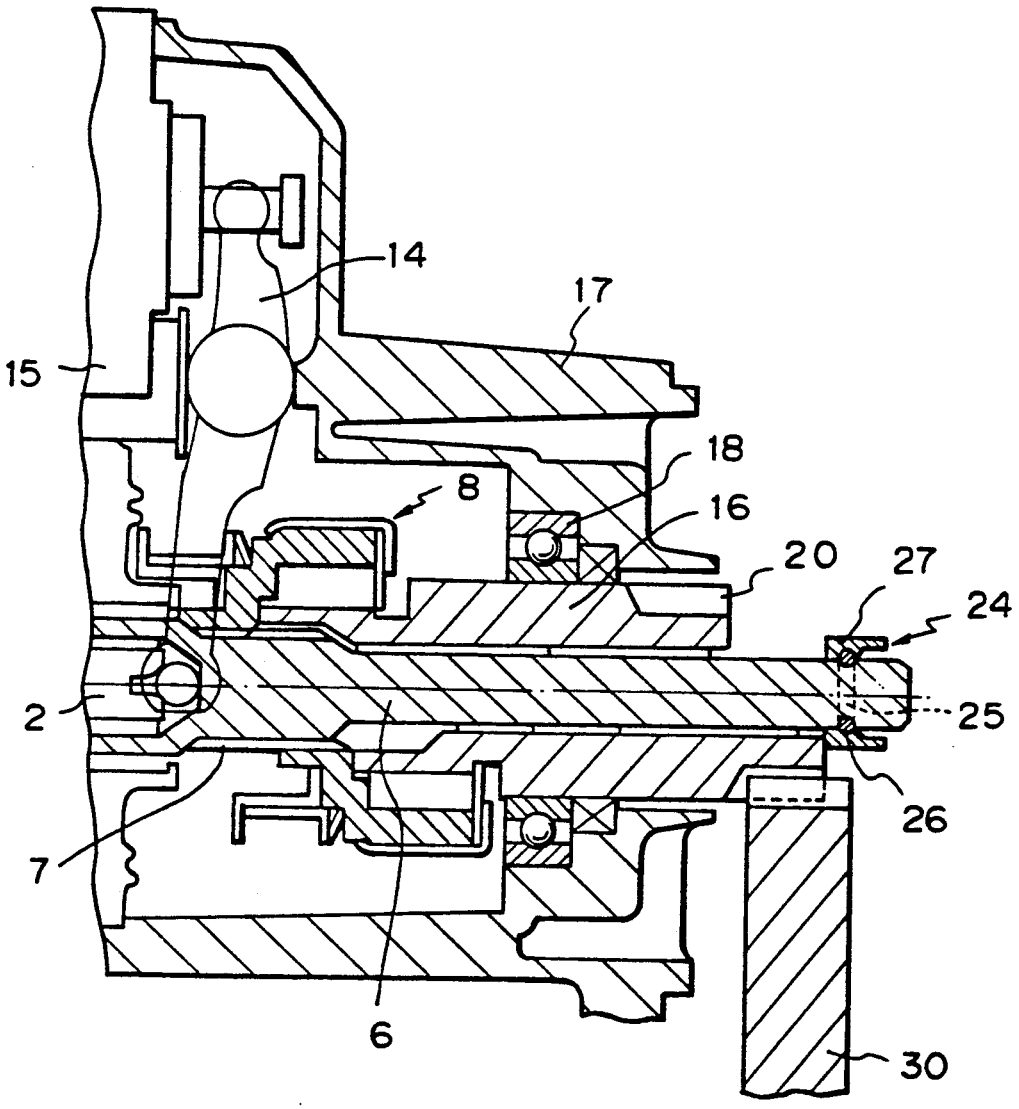
Fig. 2 PRIOR ART
FIG. 2 is a sectional view showing a conventional pinion stopper employed in an overhang type starter.
Figure 3:
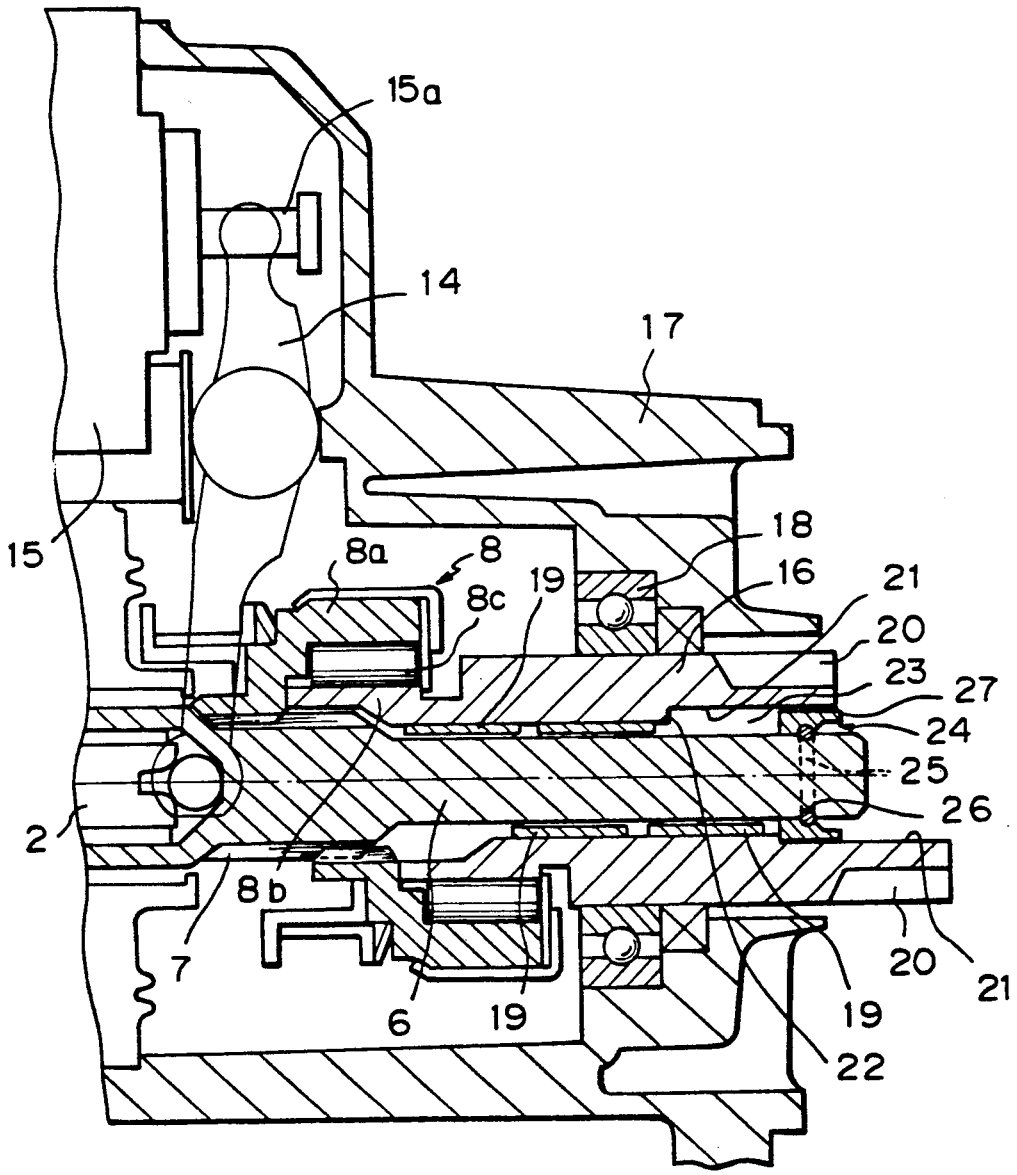
FIG. 3 is a sectional view showing a pinion stopper for a starter according to a first embodiment of the present invention.

FIG. 3 is a sectional view showing a pinion stopper for a starter according to a first embodiment of the present invention, in which the lower half of a pinion driving shaft 16 shows the shaft 16 advanced to its forward position. In this figure, the reference numerals 2, 6, 7 and 8 denote an armature rotary shaft, an output rotary shaft, a helical spline and an overrunning clutch, respectively, in the same way as in the prior art. The numerals 8*a*, 8*b* and 8*c* denote respectively a clutch outer member, a clutch inner member and rollers interposed therebetween. The clutch inner member 8*b* is formed integral with the pinion driving shaft 16 which slides on the output rotary shaft 6. The pinion driving shaft 16 is supported by a bearing 18 fitted to a front bracket 17 such that the shaft 16 is slidable axially of the output rotary shaft 6. Sleeve metal members 19 are disposed between the pinion driving shaft 16 and the output rotary shaft 6. A pinion 20 is formed integral with the distal end portion of the pinion driving shaft 16. The reference numeral 21 denotes an enlarged-diameter portion which is formed on the inner periphery of the pinion driving shaft 16 so as to extend over a predetermined length from the distal end thereof, 22 a step portion formed at the terminating end of the enlarged-diameter portion 21, and 23 an annular space defined between the enlarged-diameter portion 21 and the outer periphery of the output rotary shaft 6. The numeral 27 denotes a stopper member which constitutes a stopper means 24. The stopper member 27 has a ring-shaped cross-section of such a shape that it can be loosely fitted in the space 23. The stopper member 27 is engaged with a ring 26 fitted in a recess 25 provided in the distal end portion of the output rotary shaft 6 and it is thus positioned.

The reference numerals 14 and 15 denote a lever and an electromagnetic switch which are similar to those in the prior art, and 15*a* a plunger of the electromagnetic switch 15.

The following is a description of the procedure for assembling the stopper means 24 arranged as described above. The stopper member 27 is first inserted into the space 23 from the distal end of the output rotary shaft 6, and then the ring 26 is fitted into the recess 25. In this state, the pinion driving shaft 16 is moved forward (rightward as viewed in FIG. 3). In consequence, the step portion 22 of the pinion driving shaft 16 abuts against the stopper member 27 which is loosely fitted in the space 23 and moves the latter rightward as viewed in the figure, thus causing the stopper member 27 to engage with the ring 26. In this way, the stopper member 27 is rigidly secured.

Starting of the engine is effected in the same way as in the prior art. Namely, when a starting switch (not shown) is turned on, the electromagnetic solenoid 15 is actuated and the armature rotary shaft 2 is rotated. In consequence, the pinion 20 rotates and moves forward to mesh with a ring gear (not shown).

As has been described above, the starter pinion stopper according to the present invention is assembled in such a manner that a ring is fitted in the distal end portion of the output rotary shaft and a stopper member having such a configuration that it is loosely fitted in a space inside the pinion driving shaft is engaged with the ring. Accordingly, when the pinion is projected, the distal end of the output shaft is withdrawn into the space inside the pinion driving shaft and there is therefore no fear of it interfering with a flywheel or the like. When the pinion is withdrawn, the stopper means is partially or entirely covered with the pinion driving shaft and therefore it also functions as a dustproofing means. Thus, assembly of the pinion stopper is facilitated and the structure is also simplified. Accordingly, it is possible to lower the production cost.

Figure 4:
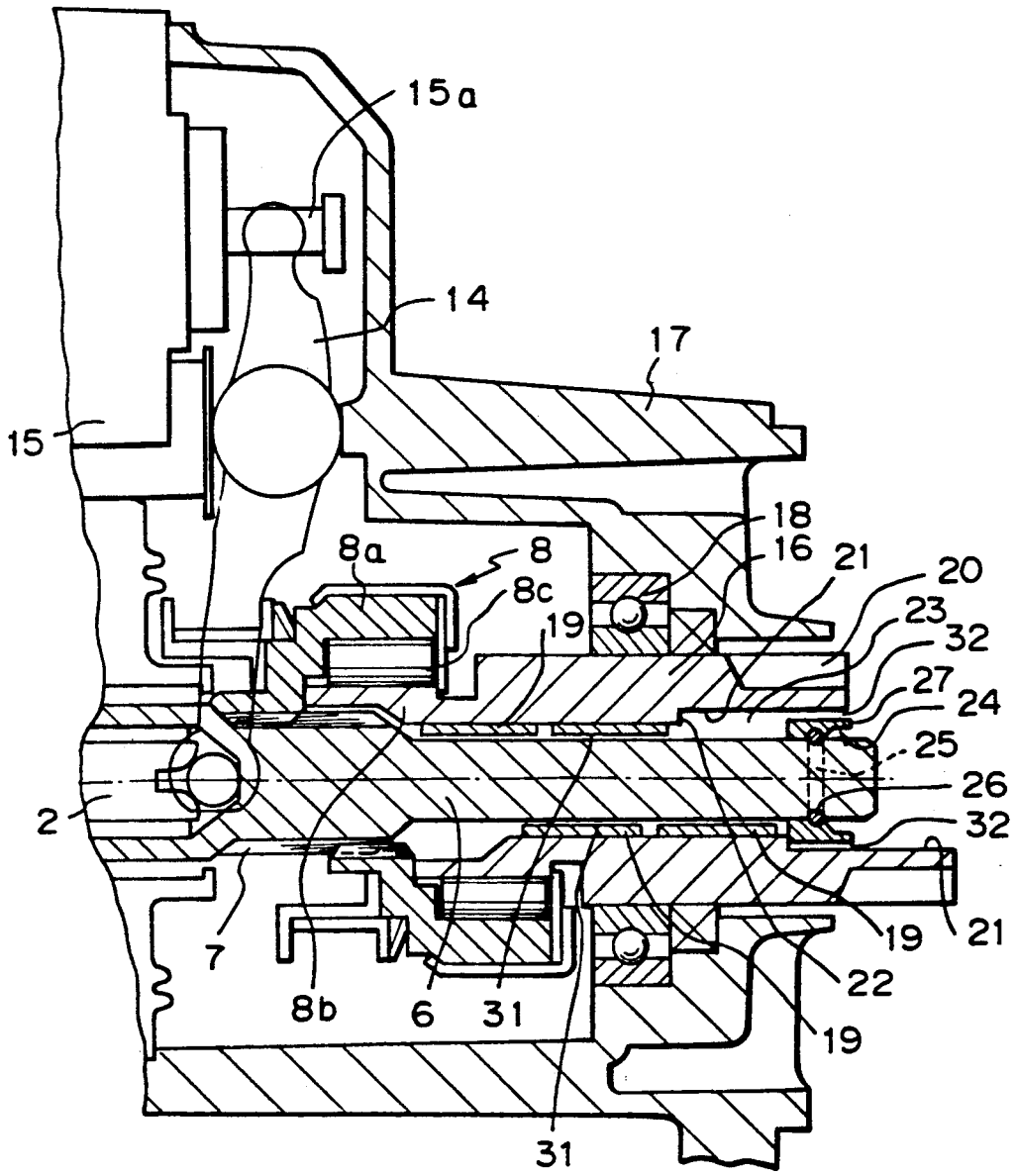
FIG. 4 a sectional view showing a pinion stopper for a starter according to a second embodiment of the present invention.

FIG. 4 is a sectional view showing a pinion stopper for a starter according to a second embodiment of the present invention, in which the lower half of the pinion driving shaft 16 shows the shaft 16 moved to its forward position. In FIG. 4, the reference numeral 31 denotes a clearance between the sleeve metal members 19 and the output rotary shaft 6, and 32 a clearance between the outer peripheral surface of the stopper member 27 and the peripheral surface of the enlarged-diameter portion 21. The space 23 is formed so that the clearance 32 is larger than the clearance 31. More specifically, the space 23 is so formed that the clearance 32 is 500 μm, whereas the clearance 31 is from 30 to 150 μm. The value of the clearance 32 is obtained by summing the value of the allowable wear of the sleeve metal members 19 and the value of the clearance 31. It is appropriate to select a value for the clearance 32 in the range of from 130 to 800 μm. Since the arrangement of the other portions is the same as that of the embodiment shown in FIG. 3, the corresponding elements or portions are denoted by the same reference numerals and description thereof is omitted.

The pinion stopper arranged as described above has the following advantage. As the starter is used, the sleeve metal members 19 become worn and the clearance 31 increases correspondingly. However, since the clearance 32 is set so as to be the sum total of the allowable wear of the sleeve metal members 19 and the clearance 31, even if the wear of the sleeve metal members 19 increases, there is no fear of the stopper member 27 interfering with the enlarged diameter portion 21 and therefore there is no risk of the stopper member 27 falling from the output rotary shaft 6.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. In a starter motor having a housing with an opening therein, a motor with an output drive shaft, said output drive shaft having an end proximal to and driven by said motor and a distal end extending through said housing opening, and a mechanical stop ring on said output drive shaft distal end, a pinion drive gear supported by a pinion driving shaft, said pinion drive gear and said pinion driving shaft having a cylindrical bore with a first diameter therethrough so that said pinion gear drive gear and said pinion driving shaft are slidable over said output drive shaft towards said distal end, and an annular bearing mounted in said housing opening for supporting said pinion drive gear and said pinion driving shaft, said cylindrical bore having a section thereof facing said output drive shaft distal end and disposed concentric with and having a second diameter less than that of at least said pinion drive gear with said second diameter larger than said first diameter so that said larger second diameter bore section is slidable over said mechanical stop ring, said pinion drive gear being located about said larger second diameter bore section, said larger second diameter bore section constituting at least an inner diameter of said pinion drive gear, said first and second diameter bore sections defining therebetween a step portion against which the stop ring may be urged, said step portion formed longitudinally between said pinon drive gear and a portion of said pinion driving shaft, said pinion drive gear and said pinion driving shaft having alternate position including a withdrawn position in which said mechanical stop ring is positioned substantially within said larger second diameter bore section and said pinion drive gear is substantially withdrawn within said housing and does not substantially extend from said housing opening, and a projected position in which said pinion drive gear extends at least partially beyond said mechanical stop ring and extends in its entirety through and beyond said bracket opening, said pinion drive gear and said pinion driving shaft being translationally displaceable between the withdrawn position and the projected position.

2. A starter motor according to claim 1 further comprising:

a sleeve metal member disposed between said output drive shaft and a portion of said pinion driving shaft other than said larger second diameter bore section;

a first clearance between said sleeve metal member and said output drive shaft; and a second clearance between said mechanical stop ring and said larger second diameter bore section when said pinion gear and said pinion driving shaft are engaged with said mechanical stop ring.

3. A starter motor according to claim 1, wherein said output drive shaft has an outer peripheral surface, said starter motor further comprising an overrunning clutch and a helical spline which is formed in the outer peripheral surface of said output drive shaft, said overrunning clutch including a clutch outer member engaged with said helical spline, a clutch inner member having said pinion driving shaft formed integral therewith, and at least one roller interposed between said clutch inner and outer members.

4. A starter motor according to claim 1, wherein said pinion drive gear is formed integral with said pinion driving shaft.

5. A starter motor according to claim 4, wherein said output rotary shaft has an outer periphery, wherein a helical spline is formed on the outer periphery of said output rotary shaft, and wherein said starter motor further comprises an overrunning clutch axially slidably disposed about said output rotary shaft and comprising:

a clutch outer member engaged with said helical spline;

a clutch inner member integral with said pinion driving shaft; and at least one roller interposed between said clutch outer member and said clutch inner member.

6. A starter motor according to claim 4, further comprising an overrunning clutch axially slidably disposed about said output rotary shaft and comprising a clutch inner member integral with said pinion driving shaft.

7. In a starter motor according to claim 1 wherein said annular bearing has an outer race supported by said housing and an inner race supported by said pinion driving shaft at a position closely adjacent said pinion drive gear.

8. In a starter motor according to claim 1, wherein:

said output drive shaft has an outer peripheral surface provided with an annular recess; and said mechanical stop ring comprises a ring fitted in said annular recess and a stopper member retained on said output drive shaft by said ring, said stopper member being configured to be slidable within said larger second diameter bore section.

9. In a starter motor having a housing with an opening therein, a motor with an output drive shaft, said output drive shaft having an end proximal to and driven by said motor and a distal end extending through said housing opening, and a mechanical stop ring on said output drive shaft distal end, a pinion drive gear supported by a pinion driving shaft, said pinion drive gear and said pinion driving shaft having a cylindrical bore with a first diameter therethrough so that said pinion drive gear and said pinion driving shaft are slidable over said output drive shaft towards said distal end, and an annular bearing mounted in said housing opening for supporting said pinion drive gear and said pinion driving shaft, said cylindrical bore having a section thereof facing said output drive shaft distal end disposed concentric with and having a second diameter less than that of at least said pinion drive gear with said second diameter larger than said first diameter so that said larger second diameter bore section is slidable over said mechanical stop ring, said first and second diameter bore sections defining therebetween a step portion against which the stop ring may be urged, said stop portion formed longitudinally between said pinion drive gear and a portion of said pinion driving shaft, a sleeve metal member disposed between said output drive shaft and a portion of said pinion driving shaft other than said larger second diameter bore section, a first clearance between said sleeve metal member and said output drive shaft, and a second clearance between said mechanical stop ring and said larger second diameter bore section when said pinion gear and said pinion driving shaft are engaged with said mechanical stop ring, wherein said first clearance between said output drive shaft and said sleeve metal member is set at from 30 to 150 μm, whereas said second clearance between said mechanical stop ring and said larger second diameter bore section of said pinion drive gear and said pinion driving shaft is set at from 130 to 800 μm.

10. A starter motor according to claim 9 wherein:

said pinion drive gear is located about said larger second diameter bore section; and said larger second diameter bore section constitutes at least an inner diameter of said pinion drive gear.

11. In a starter motor having a housing with an opening therein, a motor with an output drive shaft, said output drive shaft having an end proximal to and driven by said motor and a distal end extending through said housing opening, and a mechanical stop ring on said output drive shaft distal end, a pinion drive gear supported by a pinion driving shaft, said pinion drive gear and said pinion driving shaft having a cylindrical bore with a first diameter therethrough so that said pinion drive gear and said pinion driving shaft are slidable over said output drive shaft towards said distal end, and an annular bearing mounted in said housing opening for supporting said pinion drive gear and said pinion driving shaft, said cylindrical bore having a section thereof facing said output drive shaft distal end disposed concentric with and having a second diameter less than that of at least said pinion drive gear with said second diameter larger than said first diameter so that said larger second diameter bore section is slidable over said mechanical stop ring, said first and second diameter bore sections defining therebetween a step portion against which the stop ring may be urged, said step portion formed longitudinally between said pinion drive gear and a portion of said pinion driving shaft, a sleeve metal member disposed between said output drive shaft and a portion of said pinion driving shaft other than said larger second diameter bore section, a first clearance between said sleeve metal member and said output drive shaft, and a second clearance between said mechanical stop ring and said larger second diameter bore section when said pinion gear and said pinion driving shaft are engaged with said mechanical stop ring, wherein said second clearance between said mechanical stop ring and said larger second diameter bore section of said pinion drive gear and said pinion driving shaft is larger than said first clearance between said output drive shaft and said sleeve metal member.

12. A starter motor according to claim 11 wherein:

said pinion drive gear is located about said larger second diameter bore section; and said larger second diameter bore section constitutes at least an inner diameter of said pinion drive gear.

13. A starter motor, comprising;

a bracket having a cylindrical opening therethrough;

a motor;

an output rotary drive shaft, said output drive shaft having an end proximal to and driven by said motor, and having a distal end extending through said bracket opening;

a mechanical stop ring fixedly disposed on said output drive shaft substantially at said output drive shaft distal end;

a pinion driving shaft having an outer periphery;

a pinion forming an end termination of said pinion driving shaft distal from said motor, said pinion being integral with said pinion driving shaft, said pinion having an end distal from said pinion driving shaft;

said pinion and said pinion driving shaft having a cylindrical bore with a first diameter therethrough so that said pinion and said pinion driving shaft are slidable axially of said output drive shaft, said output drive shaft being at least partially disposed in said cylindrical bore;

said cylindrical bore having a section, at least partially disposed within said pinion, and extending within said pinion from said pinion distal end, with a diameter larger than said first diameter such that said larger diameter section is slidable over said mechanical stop ring;

said pinion and said pinion driving shaft having alternate positions including a withdrawn position in which said mechanical stop ring is positioned substantially within said larger diameter section and said pinion is substantially withdrawn within said bracket and does not substantially extend axially from said cylindrical opening, and a projected position in which said pinion extends at least partially beyond said mechanical stop ring and extends axially through and beyond said bracket opening, said pinion and said pinion driving shaft being translationally displaceable between the withdrawn position and the projected position; and a step portion, formed between the different diameter sections of the cylindrical bore, against which the stop ring is urged in the projected position, said step portion being so positioned in said bore as to limit translational displacement of said pinion beyond said projected position when directed away from said withdrawn position.

14. A starter motor according to claim 13, wherein said output rotary shaft has an outer periphery, wherein a helical spline is formed on the outer periphery of said output rotary shaft, and wherein said starter motor further comprises an overrunning clutch axially slidably disposed about said output rotary shaft and comprising:

a clutch outer member engaged with said helical spline;

a clutch inner member integral with said pinion driving shaft; and at least one roller interposed between said clutch outer member and said clutch inner member.

15. A starter motor according to claim 13, further comprising an overrunning clutch axially slidably disposed about said output rotary shaft and comprising a clutch inner member integral with said pinion driving shaft.

16. A starter motor according to claim 13, further comprising:

an annular bearing comprising inner and outer races, said outer race being fitted to said bracket adjacent said opening and said inner race being slidably disposed about said pinion driving shaft adjacent said pinion such that said pinion driving shaft is slidable axially of said output rotary shaft and rotatable with respect to said bracket.

17. A starter motor according to claim 16, wherein said output rotary shaft has an outer periphery and a helical spline is formed on the outer periphery of said output rotary shaft, and wherein said starter motor further comprises an overrunning clutch axially slidably disposed about said output rotary shaft and comprising:

a clutch outer member engaged with said helical spline;

a clutch inner member integral with said pinion driving shaft; and at least one roller interposed between said clutch outer member and said clutch inner member.

18. In a starter motor having a housing with an opening therein, a motor with an output drive shaft, said output drive shaft having an end proximal to and driven by said motor and a distal end extending through said housing opening, and a mechanical stop ring on said output drive shaft distal end, a pinion drive gear supported by a pinion driving shaft, said pinion drive gear and said pinion driving shaft having a cylindrical bore with a first diameter therethrough so that said pinion drive gear and said pinion driving shaft are slidable over said output drive shaft towards said distal end, said cylindrical bore having a section thereof facing said output drive shaft distal end and disposed concentric with and having a second diameter less than that of at least said pinion drive gear with said second diameter larger than said first diameter so that said larger second diameter bore section is slidable over said mechanical stop ring, said pinion drive gear being located about said larger second diameter bore section, said larger second diameter bore section constituting at least an inner diameter of said pinion drive gear, a sleeve metal member disposed between said output drive shaft and a portion of said pinion driving shaft other than said larger second diameter bore section;

a first clearance between said sleeve metal member and said output drive shaft; and a second clearance between said mechanical stop ring and said larger second diameter bore section when said pinion gear and said pinion driving shaft are engaged with said mechanical stop ring, wherein said second clearance between said mechanical stop ring and said larger second diameter bore section of said pinion drive gear and said pinion driving shaft is larger than said first clearance between said output drive shaft and said sleeve metal member.

19. A starter motor according to claim 18, wherein said first clearance between said output drive shaft and said sleeve metal member is set at from 30 to 150 μm, whereas said second clearance between said mechanical stop ring and said larger second diameter bore section of said pinion drive gear and said pinion driving shaft is set at from 130 to 800 μm.

20. A starter motor, comprising:

a bracket having a cylindrical opening therethrough;

a motor;

an output rotary drive shaft, said output drive shaft having an end proximal to and driven by said motor, and having a distal end extending through and beyond said bracket opening;

a mechanical stop ring fixedly disposed on said output drive shaft substantially at said output drive shaft distal end;

a pinion driving shaft having an outer periphery;

a pinion forming an end terminator of said pinion driving shaft distal from said motor, said pinion being integral with said pinion driving shaft, said pinion having an end distal from said pinion driving shaft;

said pinion and said pinion driving shaft having a cylindrical bore wtih a first diameter therethrough so that said pinion and said pinion driving shaft are slidable axially of said output drive shaft, said output drive shaft being at least partially disposed in said cylindrical bore;

said cylindrical bore having a section, at least partially disposed within said pinion, and extending within said pinion from said pinion distal end, with a diameter larger than said first diameter such that said larger diameter section is slidable over said mechanical stop ring;

said pinion and said pinion driving shaft having alternate positions including a withdrawn position in which said mechanical stop ring is positioned substantially within said larger diameter section, and a projected position in which at least part of said pinion axially extends substantially beyond said mechanical stop ring and through and beyond said bracket opening, said pinion and said pinion driving shaft being translationally displaceable between the withdrawn position and the projected position; and a step portion, formed between the different diameter sections of the cylindrical bore, against which the stop ring is urged in the projected position, said portion being so positioned in said bore within said pinion driving shaft as to limit translational displacement of said pinion beyond said projected position when directed away from said withdrawn position.

21. A starter motor according to claim 20, wherein said step portion is disposed within said bracket opening.

22. A starter motor according to claim 20, further comprising an annular bearing mounted in said bracket for rotatably supporting said pinion and said pinion driving shaft, wherein said step portion is disposed between said annular bearing and said mechanical stop ring.

23. A starter motor according to claim 20, wherein said step portion is disposed adjacent to, but proximal of, said pinion.

24. A starter motor according to claim 20, wherein said step portion is maintained within said bracket opening in both withdrawn and projected positions.

25. In a starter motor having a housing with an opening therein, a motor with an output drive shaft, said output drive shaft having an end proximal to and driven by said motor and a distal end extending through said housing opening, and a mechanical stop ring on said output drive shaft distal end, a pinion drive gear supported by a pinion driving shaft, said pinion drive gear and said pinion driving shaft having a cylindrical bore with a first diameter therethrough so that said pinion drive gear and said pinion driving shaft are slidable over said output drive shaft towards said distal end, and an annular bearing mounted in said housing opening for supporting said pinion drive gear and said pinion driving shaft, said cylindrical bore having a section thereof facing said output drive shaft distal end and disposed concentric with and having a second diameter less than that of at least said pinion drive gear with said second diameter larger than said first diameter so that said larger second diameter bore section is slidable over said mechanical stop ring, said pinion drive gear being located about said larger second diameter bore section, said larger second diameter bore section constituting at least an inner diameter of said pinion drive gear and of part of said pinion driving shaft, said first and second diameter bore sections defining therebetween a step portion against which the stop ring may be urged, said step portion formed longitudinally within said pinion driving shaft.

26. A starter motor according to claim 25, wherein said step portion is disposed within said housing opening.

27. A starter motor according to claim 25, wherein said step portion is disposed between said annular bearing and said mechanical stop ring.

28. A starter motor according to claim 25, wherein said step portion is disposed adjacent to, but proximal of, said pinion.

29. A starter motor according to claim 25, wherein said step portion is maintained within said bracket opening in both withdrawn and projected positions.

* * * * *